US006007041A

United States Patent [19]

Law

[11] Patent Number: 6,007,041

[45] Date of Patent: Dec. 28, 1999

[54] WALL PLATE HOLDER

[75] Inventor: Wun Fung Law, Hong Kong, The Hong Kong Special Administrative Region of the People's Republic of China

[73] Assignee: Ngai Ming Houseware Manufactory Company Limited, Hong Kong, The Hong Kong Special Administrative Region of the People's Republic of China

[21] Appl. No.: 09/159,055

[22] Filed: Sep. 23, 1998

[51] Int. Cl.[6] ..... A47G 1/16

[52] U.S. Cl. ..... 248/491; 248/490; 248/494

[58] Field of Search ..... 248/491, 490, 248/468, 494, 408

[56] References Cited

U.S. PATENT DOCUMENTS

| | | | |
|---|---|---|---|
| 213,264 | 3/1879 | Vizet | 248/490 |
| 711,056 | 8/1902 | Larkin | 248/491 |
| 2,365,108 | 12/1944 | Richards | 248/490 |
| 2,488,243 | 11/1949 | Schneir | 248/491 |
| 2,614,778 | 8/1952 | Graves | 248/490 |
| 2,737,361 | 3/1956 | Petzke | 248/491 |
| 2,877,585 | 3/1959 | Horwitt | 248/490 |
| 2,899,154 | 8/1959 | Zavolner | 248/491 |
| 4,106,742 | 8/1978 | Miller et al. | 248/491 |
| 4,223,864 | 9/1980 | Harlow | 248/490 |
| 4,542,875 | 9/1985 | DeBaun et al. | 248/491 |
| 4,542,876 | 9/1985 | Hogg | 248/491 |

FOREIGN PATENT DOCUMENTS 1583774 2/1981 United Kingdom .

*Primary Examiner*—Leslie A. Braun
*Assistant Examiner*—Debbie Short
*Attorney, Agent, or Firm*—Jackson Walker L.L.P.

[57] ABSTRACT

A wall plate holder comprising two opposing parts that are held together by a bracket and a coiled spring. The bracket has a number of hooks that allow the effective size of the holder (i.e. the distance between fingers on the parts that grip around the periphery of a plate). In this way the same holder can be safely and satisfactorily used for a wide range of diameter plates.

5 Claims, 2 Drawing Sheets

WALL PLATE HOLDER

BACKGROUND OF THE INVENTION

1. Field of the Invention

The invention relates to wall plate holders.

2. Description of Prior Art

It is common to store, or more usually, display decorative plates and the like against a wall. It is known to provide a wall plate holder that comprises opposing plate gripping parts that are resiliently held together behind the plate so as to be readily attachable and removable from the plate as required. Generally stated, the present wall plate holders must be provided in sizes respectively that match only plates of one at least roughly the same size or diameters of plates. Thus, wall plate holders must be made up and stored for each range of sizes of plates, leading to limited application and relatively high cost.

SUMMARY OF THE INVENTION

It is an object of the invention to overcome or at least reduce this problem.

According to the invention there is provided a wall plate holder comprising a pair of opposing parts having fingers arranged to grip around a periphery of a plate, a bracket that connects between the opposing parts, and including a resilient tie between one of the parts and the bracket, in which the bracket is formed with a number of first anchoring points for the resilient tie arranged to be selectable in use to vary the effective distance between the opposing parts.

The bracket preferably has a plurality of second anchoring points arranged to be selectable in use to connect the bracket to the other of the opposing parts.

The bracket may have an aperture for receiving a wall mounted peg to hold the bracket to the wall.

The opposing parts and the bracket are preferably formed of stainless steel.

The resilient mean may comprise a coiled spring, that is formed of metal.

BRIEF DESCRIPTION OF THE DRAWINGS

Wall plate holders according to the invention will now be described by way of example with reference to the accompanying drawings in which.

DESCRIPTION OF THE PREFERRED EMBODIMENTS

Figure 1:
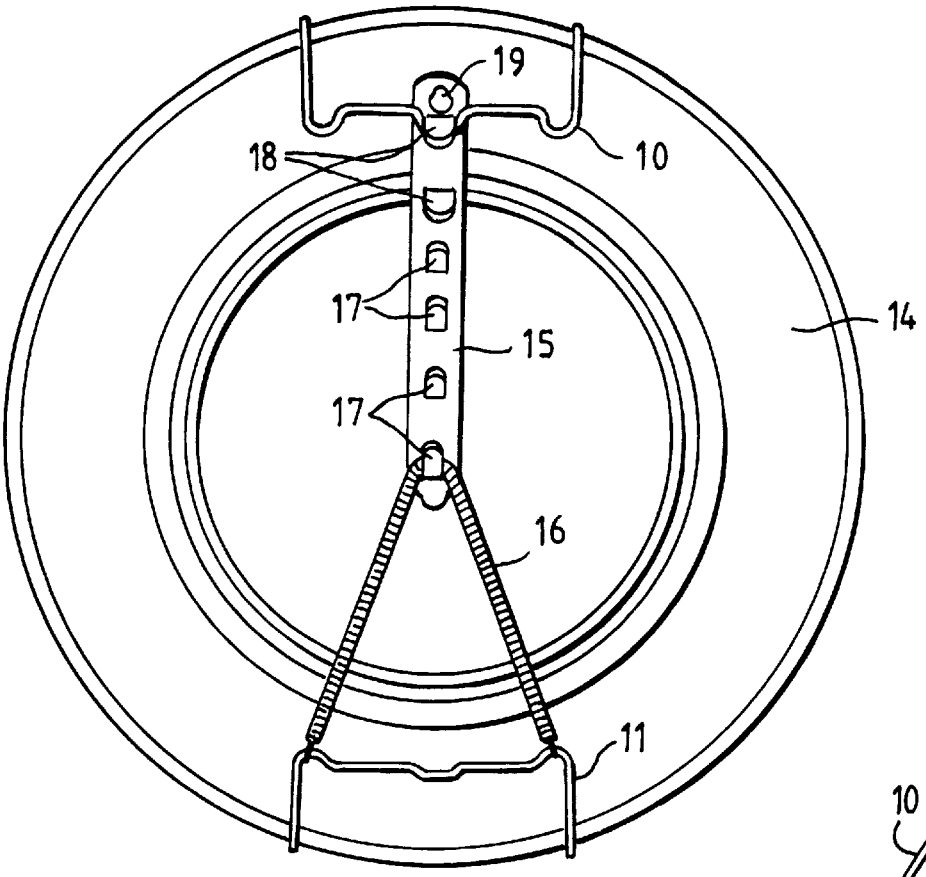
FIG. 1 shows a plan view of one wall plate holder.
Figure 2:
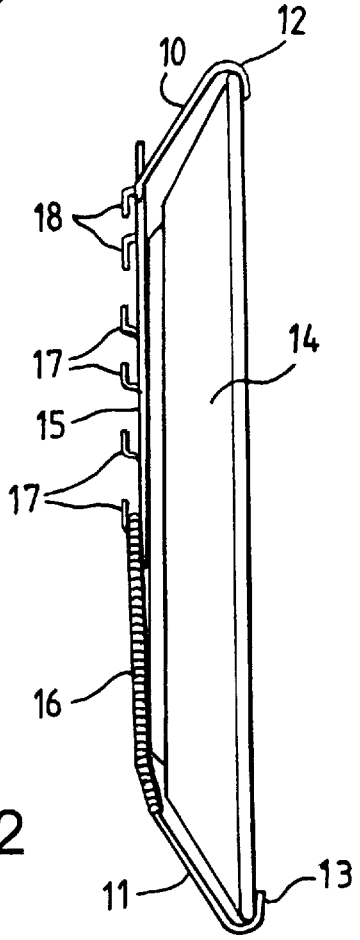
FIG. 2 shows a side view of the wall plate holder.

Referring to the drawings, in FIGS. 1 and 2 a pair of opposing parts 10 and 11 have fingers 12 and 13 that grip around a periphery of a plate 14. A bracket 15 is connected between the second parts 11 and 11 by a coiled spring 16. The coiled spring is attached to the part 10 by being tied to one of a number of first anchoring hooks 17 on the bracket 15. The bracket 15 is attached to the first part 10 by one of two second anchoring hooks 18. The bracket 15 also has an aperture 19 to receive a wall mounted peg (not shown) that holds the bracket 15, and the plate 14, to a wall surface in use.

In the FIGS. 1 and 2, the wall plate holder is shown gripping a maximum diameter plate for this holder. In other words, the bracket 15 is connected between the two opposing parts 10 and 11 by extreme of its first and second anchoring hooks. If a smaller plate is present, other of the hooks 17 and/or 18 are used to reduce the effective practical distance between the fingers 12 and 13. In this way, the described wall plate holder can be used with a wide range of diameter of plates.

In prior art holders that do not have a bracket with selectable anchoring hooks, a coiled spring is also used. As such the coiled spring inherently can allow certain ranges of diametered plates to be held by the holder, using similar opposing parts to those shown in FIGS. 1 and 2. However, this may lead to insecure holding of the plate, or over-strain the spring. More importantly, as the wall plates may well be somewhat fragile, and often very valuable, it is very important to apply a firm but not over-strong pressure between the fingers 12 and 13. The described wall plate holder being readily adjustable ensures this balance of good gripping and no over-strain of the spring or over-stress of the plate itself is well maintainable.

Figure 3:
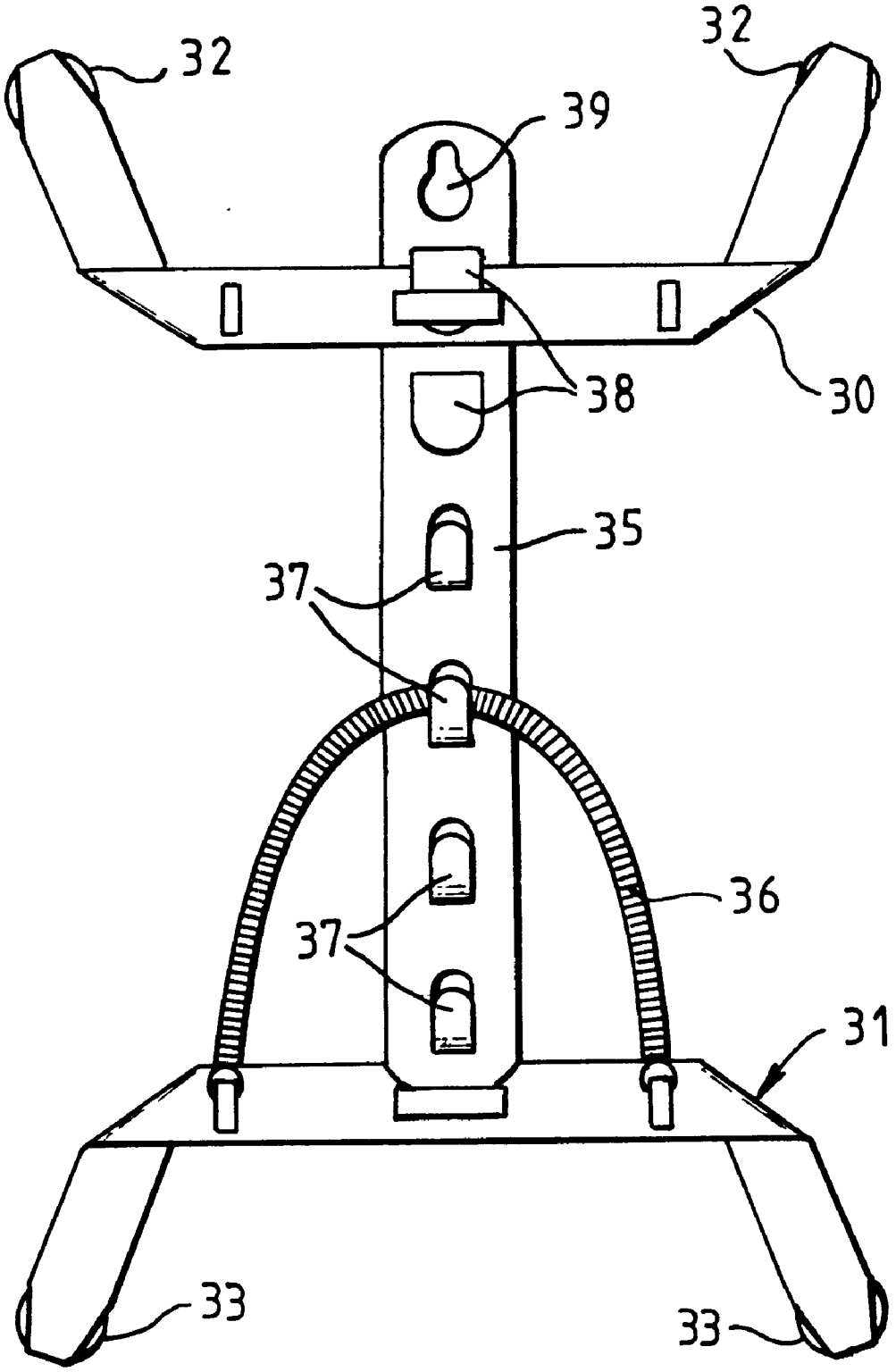
FIG. 3 shows a plan view of another wall plate holder.

In FIG. 3, like parts to FIGS. 1 and 2 are shown using corresponding numerals. A bracket 35 has a number of first and second anchoring hooks 37 and 38 that a selectable, as before, to adjust the effective distance between fingers 32 and 33, as desired, to grip around the periphery of a plate (not shown). It will be noted that the opposing parts 30 and 31 are totally inter-chargeable to either be connected directly the bracket 35 or to a coiled spring 36. An aperture 39 is provided to receive a wall mounted peg (not shown).

I claim:

1. A wall plate holder comprising:

a pair of identical opposing U-shaped parts in which limbs of each U-shaped part have fingers arranged to grip around a periphery of a plate;

a bracket connecting between said opposing parts and having a single resilient tie extending between spaced adjacent finger bases of a first of said opposing parts and over one of a multiplicity of selectable first anchor points on said bracket, said anchor points arranged in a first direction open toward the second of said opposing points to be selectable in use to vary an effective distance between said opposing parts, and in which said bracket has a plurality of second anchoring points arranged in a second direction opposite said first direction to be selectable in use to connect said bracket to said second of said opposing parts.

2. A wall plate holder according to claim 1, in which said bracket has an aperture for receiving a wall mounted peg to hold said bracket to said wall.

3. A wall plate holder according to claim 1, in which said opposing parts and said bracket are formed of stainless steel.

4. A wall plate holder according to claim 1, in which said resilient mean comprises a coiled spring.

5. A wall plate holder according to claim 4, in which said spring is formed of metal.

* * * * *